United States Patent [19]

Lefebvre

[11] Patent Number: 4,540,161

[45] Date of Patent: Sep. 10, 1985

[54] INSTALLATION FOR THE FUSION OF METAL INGOTS

[75] Inventor: Guy Lefebvre, Bourron-Marlotte, France

[73] Assignee: Dynamold International, Melun, France

[21] Appl. No.: 598,005

[22] Filed: Apr. 9, 1984

[51] Int. Cl.[3] ..... F27B 9/38

[52] U.S. Cl. ..... 266/95; 266/206; 432/239

[58] Field of Search ..... 266/94, 95, 206, 200, 266/901; 164/450, 156; 432/239

[56] References Cited

U.S. PATENT DOCUMENTS

| | | | |
|---|---|---|---|
| 1,032,306 | 7/1912 | Spencer | 266/94 |
| 1,215,677 | 2/1917 | Marlatt | 164/156 |
| 2,122,233 | 6/1938 | Dunsheath | 266/95 |
| 2,245,275 | 6/1941 | Jung et al. | 266/95 |
| 4,456,229 | 6/1984 | Bühner et al. | 266/95 |

*Primary Examiner*—L. Dewayne Rutledge
*Assistant Examiner*—S. Kastler
*Attorney, Agent, or Firm*—Albert L. Jeffers; Stephen T. Belsheim

[57] ABSTRACT

An installation for the fusion of metal ingots so as to provide a continuous supply of the metal ingots to an electric furnace in a safe fashion. The installation includes a rail on which can be suspended several metal ingots one behind the other. The rail is inclined towards the surface of the bath of molten metal so that its lower end is situated above the surface of the bath and so that the ingots slide along the rail under their own weight towards the lower end. A means of suspension is controlled so as to move from its higher position to its lower position by a mechanism activated by a float.

8 Claims, 7 Drawing Figures

Figures 1, 2:
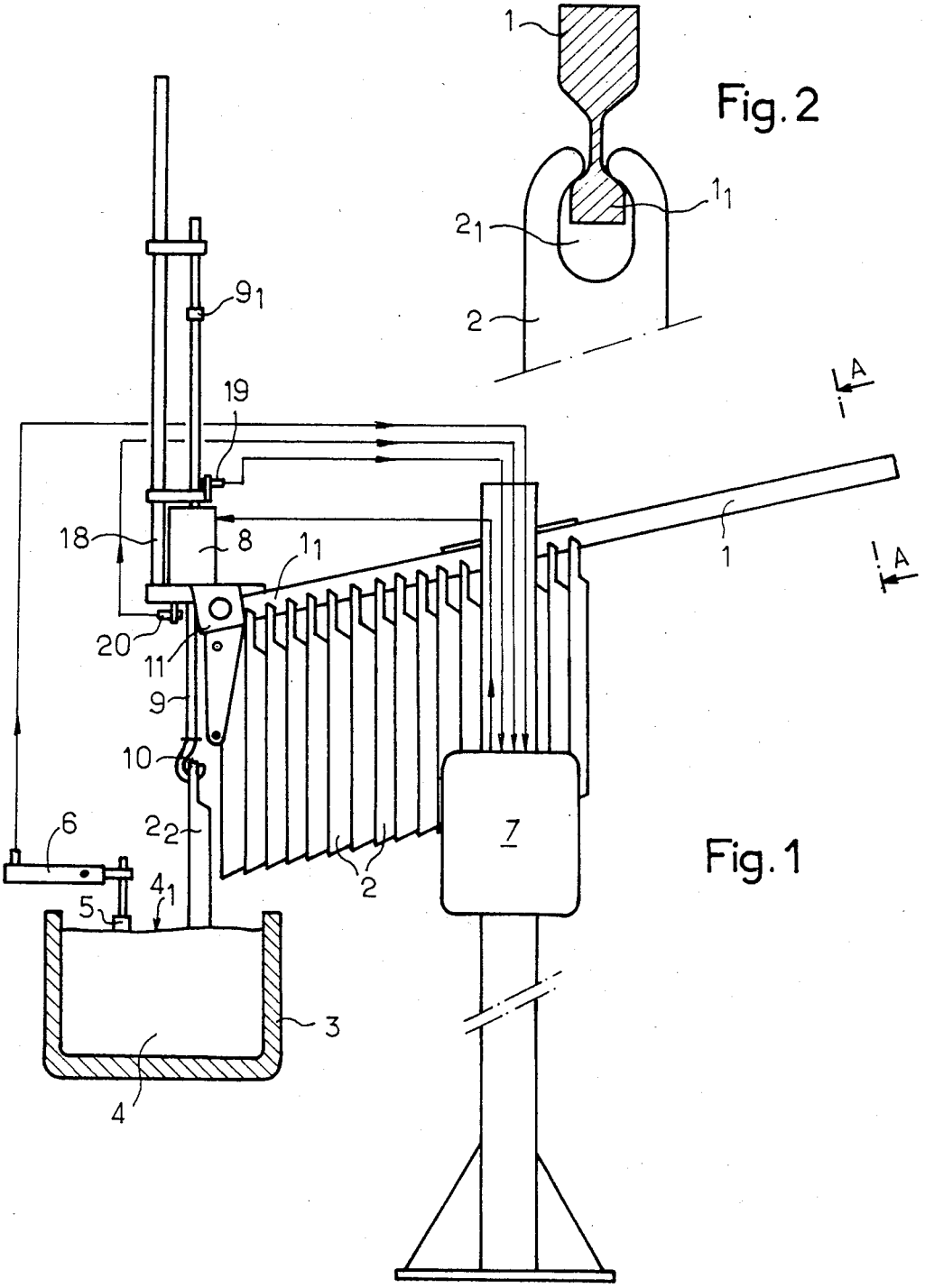

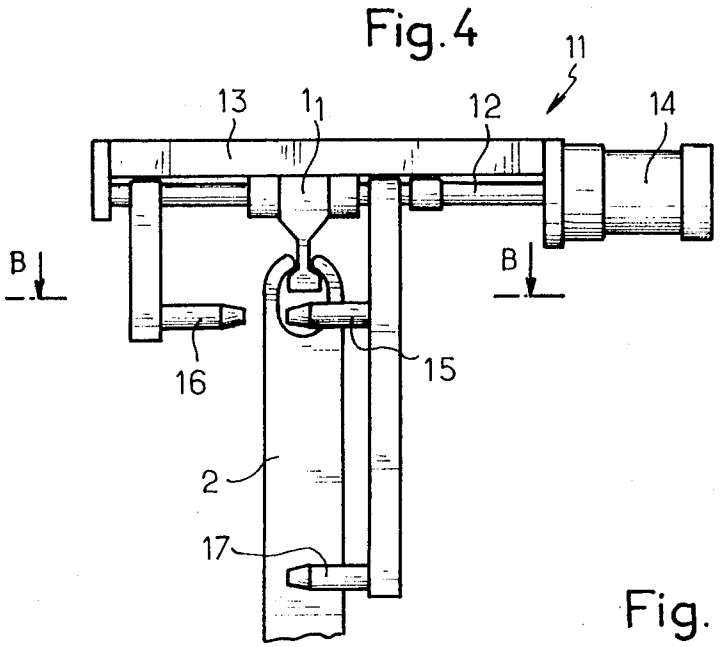
Fig. 4
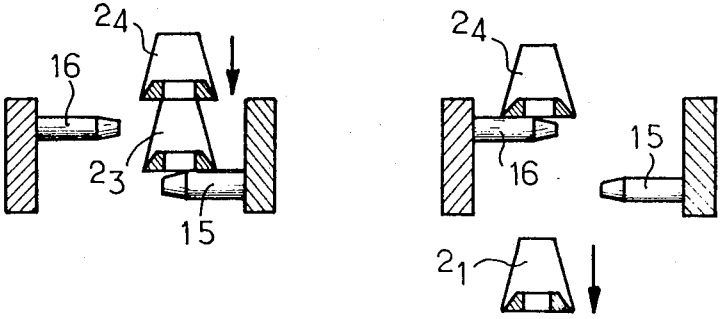
Fig. 6
Fig. 5
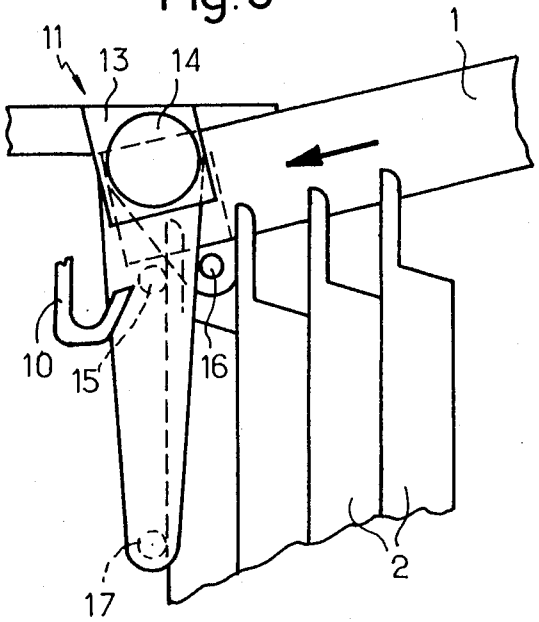
Fig. 3

INSTALLATION FOR THE FUSION OF METAL INGOTS

The invention concerns an installation for the fusion of metal ingots.

Installations for the fusion of metal ingots consist of an electric furnace in which the ingots of metal or alloy are melted. This furnace supplies, for example continuously, an injection machine which injects this molten metal into a mould for the production of moulded metal parts.

However, in order to obtain moulded parts of high quality (homogeneity and accuracy), it is very important that the temperature of the bath of molten metal be kept constant, and this can only be achieved by maintaining the quantity of metal in this bath constant, despite the consumption of metal resulting from the injection machine.

This precision in the bath temperature is particularly important when a metal or alloy with a low melting point and a very short viscous fusion range, such as zinc alloys, is involved.

In order to try and achieve these results, there has previously been provided on these installations, a device which consists of a float, which floats on the surface of the fused metal bath and which is connected, by means of a cable and an assembly of springs and ratchets, to a hook on which a metal ingot is suspended.

Thus, theoretically, when the float detects a reduction in the level of the bath of molten metal in the furnace, in one movement it controls the lowering of the ingot into the bath, in order to keep the quantity of metal constant.

However, this known installation has many disadvantages.

Thus, of the solidification time of the moulded parts allows, it might be possible to increase the rate of the injection cycles.

However, in this case, it would become very difficult by using this device, to maintain the quantity of molten metal in the bath, and consequently its temperature, since each time the float is tripped, the descending movement of the ingot becomes significant, and this results in a large quantity of cold metal plunging into the fusion bath where it reduces the temperature, and this causes the installation to stop, with all the inconveniences that this involves when it is started up again.

Also, with such a device, when the ingot has been completely consumed, it is necessary to immediately replace the lowering device into its starting position and to hang on another ingot, since any loss of time results in a reduction in the quantity of metal in the bath, and so an increase in its temperature, when there is again a reason for the installation to stop.

Such a known installation, therefore requires the permanent presence of workmen, but in spite of this, the replacement of ingots cannot always be made in sufficient time, because each worker must supervise several fusion installations and this means that the furnace battery may require the simultaneous replacement of several ingots.

Furthermore, during these replacement operations, the workman must quickly fasten the ingot onto a hook situated above the bath, and this involves a great risk of being burned by projection of molten metal, if the ingot escapes from the workman and falls into the bath.

The present invention has the particular aim of overcoming these disadvantages, and for this purpose, concerns an installation for the fusion of metal ingots, which consists of a fusion furnace, a float which detects variations in the level of the bath of molten metal in the furnace, and a mechanism which is actuated be the float, controlling the progressive descent of the metal ingot into the bath, the installation being characterised by the fact that it incorporation a rail on which several metal ingots can be suspended, one behind the other, this rail being inclined towards the surface of the bath in such a way that its lower end is situated above the surface of the bath, and that the ingots slide along the rail under their own weight towards this lower end, a means for retaining the ingots at the lower end of the rail and which can deliver, when activated, the first of the ingots near the lower end of the rail, a means for anchoring the ingot delivered by the means of retention, which can be displaced between a high position, in which it is situated in a position adjacent to the lower end of the rail, and a low position, in which it is situated a small distance from the surface of the bath, this means for anchoring being controlled to move from its high position towards its low position by the mechanism activated by the float.

According to another characteristic of the invention, the means for retention consists of two finger bars, in one piece with a supporting axle, mobile in a direction perpendicular to the rail, these finger bars, parallel to their supporting axle, being separated one from the other in a longitudinal direction in relation to the rail, the free ends of these finger bars being directed towards each other.

According to another characteristic of the invention the free ends of the finger bars are spaced at a distance which is less than the width of an ingot.

According to another characteristic of the invention, the rail is made in the general from of an I, the ingots being suspended by an open eyehole at their ends, on the lower traverse of the I which forms a sliding track.

According to another characteristic of the invention, the means for anchoring is formed by a hook fixed at the lower end of the rod of a jack, this rod being arranged vertically in front of the lower end of the rail and opposite the finger bars, in relation to the ingot.

Figure 7:
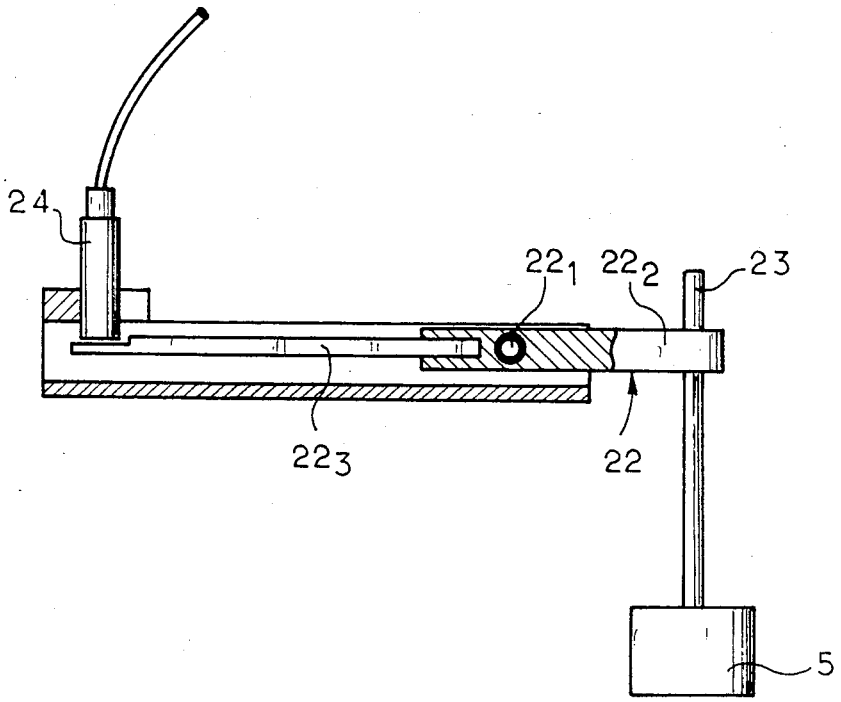

The invention is shown, as a non-limiting example, in the enclosed drawings in which:

FIG. 1 as a view of the whole of the installation according to the invention, FIG. 2 is a section along A—A of FIG. 1, FIG. 3 is a detail drawing of the retaining device of FIG. 1, FIG. 4 is a view of the left-hand side of FIG. 3, FIGS. 5 and 6 are sections along B—B of FIG. 4, showing the two successive positions of the retaining device during the positioning of a new ingot, FIG. 7 is a view, in partial section, of the float and its support mechanism.

The present invention consequently has the aim of the construction of an installation for the fusion of metal ingots in a furnace, which ensures a regular and precise lowering of each ingot towards the metal bath, a rapid and automatic replacement of the ingot when the previous ingot has been completely consumed, and does it without needing the presence of a workman during the replacement, and which also permits the reloading of the installation with ingots while overcoming the risk of accidents which may be caused by the projection of metal from the bath.

This installation consists of a rail 1, in the general form of an I, on the lower traverse of which $1_1$, the ingots 2 of the metal or alloy which is being melted, are suspended one behind the other, by means of the open eyehole $2_1$, which they have at their ends.

This rail 1, is inclined towards the vat of an electric furnace 3, which contains the bath 4, of the metal being fused, the lower and $1_1$ being arranged vertical to this vat 3.

A float 5 is placed on the surface $4_1$ of the bath 4, which is intended to detect variations in the level $4_1$ of the bath, in order to keep this level at a constant value by progressive lowering of an ingot $2_2$ into this bath, the progressive fusion of which this equilibrates the consumption of molten metal from the bath, this consumption being produced by a machine, for example an injection machine, which is supplied with the metal from this bath.

In order to ensure this progressive lowering of the ingot $2_2$, the float 5 is connected, by means of a lever mechanism 6 and an electrical box 7, to an electric jack 8, the rod of which 9, is arranged vertically and carries at its lower end, a hook 10, from which the ingot $2_2$ is suspended.

When the hook 10 arrives in the lower position near the surface $4_1$ of the bath, the base of the eyehole $2_1$ melts, and this frees the two branches of the eyehole which fall into the bath. The hook 10 then returns to its higher position opposite the lower and $1_1$ of the rail 1, so that the means of retention 11, provided at the lower end of the rail, releases the first of the ingots which are arranged on the rail, and ensures its transfer to the hook 10, the lowering of this hook 10, then allowing metal to be supplied again to the bath 4.

The mechanism for retention and transfer (see FIGS. 3 to 6), consists of an axle 12, arranged horizontally, perpendicular to and on a level with the lower and $1_1$ of the rail 1, this axle being capable of being moved back and forth by sliding on a support 13, under the action of a pneumatic screw 14.

This axle 12 has two upper finger bars 15 and 16, and a lower finger bar 17.

These three finger bars, 15, 16, 17, are parallel to the axle 12, that is perpendicular to the rail 1, the finger bar 17, which points in the same direction as the finger bar 15, being arranged vertical to and below the finger bar 15.

Furthermore, the finger bar 16, in displaced in relation to the finger bar 15 in the longitudinal direction in relation to the rail, while the free ends of these finger bars 15 and 16, which are facing each other, are spaced at a distance which is less than the width of an ingot 2.

The function of this device is as follows:

While one of the ingots, suspended on the hook 10, supplies the bath 4 with metal, all the spare ingots 2 on the rail 1, are held on this rail by the finger bar 15 (see FIGS. 4 and 5).

When ingot $2_2$ has been completely consumed, the hook 10 returns to its higher position in front of the lower end $1_1$ of the rail 1 (see FIG. 3) and the screw 14 is activated in order to displace the axle 12 and consequently the finger bars 15, 16 and 17, towards the right (FIG. 6).

The finger bar 15, on which the first ingot $2_3$ from the rail is fixed, then disengages from this ingot which slides to the end of the rail $1_1$ so that it is anchored by its eyehole $2_2$, onto the hook 10.

Simultaneously, and before the finger bar 15 is completely disengaged from the ingot 3, the finger bar 16 moves in front of the second ingot $2_4$ in order to retain it.

Immediately after this displacement of the axle 12 from left to right, the supply to the screw 14 is reversed in order to displace the finger bars 15, 16 and 17 towards the left, and this causes the finger bar 16 to become disengaged from the second ingot $2_4$, which by sliding to the end $1_1$ of the inclined rail 1, catches against the finger bar 15, this second ingot $2_4$ then takes the place of the first ingot $2_3$ now being held by the hook 10.

The finger bar 17, arranged vertical to the finger bar 15, is intended, together with this finger bar 15, to prevent rocking of the ingots on the rail, after all these ingots have slid along the rail along the activation of mechanism 11.

In fact, such rocking may lead the first ingot $2_3$ on the rail 1, to strike the ingot $2_2$, and this might result in the risk of it being separated from the hook 10.

The jack 8 is fixed onto a support 18, which has two contacts 19 and 20, which are formed, for example, by proximity detectors.

The contact 20 cooperates with the hook 10 in order to detect the presence of this hook in the higher position on a level with the lower end $1_1$ of the ramp 1, this contact 20 then commanding the retaining mechanism 11, by means of the electric box 7, in order to determine the distribution of the ingots 2 on the rail.

The contact 19 cooperates with a stop $9_1$, mounted in an adjustable fashion on the rod 9 of the jack, in order to detect the lower position of the hook 10, that is when the ingot $2_2$ has been completely melted, and in order to control inversion of the supply to the electric jack 8, through the box 7, in order to return the hook 10 to the higher position.

The lever mechanism 6, activated by the float 5 and controlling the supply, step by step, to the electric jack 8 through the box 7 in order to make the ingot $2_2$ descend progressively into the bath, consists of a lever 22 (see FIG. 7) which is mounted to pivot on a horizontal axle $22_1$.

This lever has two branches of unequal length, the shorter branch $22_2$ supporting the float 5 in an adjustable manner by means of a rod 23, while the free end of the longer branch $22_3$ is arranged on a level with a contact which is formed by a proximity detector 24.

This lever 22, with unequal arms, forms a mechanical amplifier for the vertical movement of the float 5, so that the slightest variation in the level $4_1$ of the bath is immediately detected by the proximity detector 24, which then ensures that the jack 8 is supplied through the box 7, in order to make the bar 9 descend and consequently the ingot $2_2$ to descend also by a small constant distance which is just sufficient to bring back the level $4_1$ of the bath to its pre-adjusted value.

The installation according to the invention, thus allows regular and precise lowering of the ingot $2_2$ suspended on the hook 10, and also rapid and automatic replacement of this ingot $2_2$ when it has been completely melted, by activation of the retention device 11.

Also, the operation of this installation is carried out in an automatic manner, without the need for the permanent presence of a workman, it being given that the rail 1 can carry a large number of ingots 2, to ensure automatic functioning for several hours, these ingots sliding under their own weight on the inclined rail 1, in accordance with their consumption.

This automatic operation of the installation, also avoids manipulation of the ingots above the bath in order to anchor them, and this avoids the risck of accidents, since reloading of the installation with ingots is carried out at the upper end of the rail 1, at a point distant from the furnace 3.

I claim:

1. In an installation for the fusion of metal ingots including an electric furnace, a float which detects variations of the level of the bath of molten metal in the furnace, and a mechanism, activated by the float, for controlling the progressive lowering of a metal ingot into the bath, wherein the installation includes a rail on which can be suspended several metal ingots one behind the other, said rail being inclined towards the surface of the bath so that its lower end is above the surface of the bath and so that the ingots slide along the rail under their own weight towards said lower end, a means of retention for the ingots at the lower end of the rail which can deliver, when it is activated, the first of the ingots adjacent to the lower end of the rail, a means of anchoring for the ingots delivered by the means of retention which can be displaced between a high position where it is situated in a position adjacent to the lower end of the rail and a low position in which it is situated above and near the surface of the bath, said means of anchoring being commanded to move from its high position to its low position by the mechanism which is activated by the float, said means of retention has two finger bars in one piece with a supporting axle which is capable of movement perpendicular to the rail, said finger bars being parallel to their supporting axle and being displaced in relation to each other along a longitudinal direction in relation to the rail, the free ends of said finger bars facing each other.

2. The installation according to claim 1 wherein the free ends of the finger bars are spaced at a distance which is less than the width of an ingot.

3. The installation according to claim 1 wherein the support axle of the finger bars is driven in alternating movement so that during displacement in one direction it disengages the first finger bar from the first ingot adjacent to the end of the rail and simultaneously engages the second finger bar into the front of the second ingot, and during displacement in the opposite direction the finger bars return to the initial positions in which the second ingot is held on the first finger bar.

4. The installation according to claim 3 wherein the support axle of the means of retention includes a third finger bar parallel to and pointing in the same direction as the first finger bar, said third finger bar being situated under the first finger bar and vertically below it.

5. The installation according to any of the preceding claims wherein the rail is made in the general form of an I, the ingots being suspended by means of an open eyehole at the ends thereof on the lower traverse of this I-shaped rail which forms a sliding track.

6. The installation according to claims 1, 2, 3 or 4 wherein the means for suspension includes a hook fixed at the lower end of the rod of a jack, said rod being placed vertically in front of the lower end of the rail and opposite the finger bars in relation to the ingots.

7. The installation according to claim 6 wherein the rod of the jack cooperates with two electrical contacts defining the high and low positions of the hook, the contact which defines the higher position of the hook commanding the activation of the support rod of the means of retention, the contact which defines the lower position of the hook ensuring the reversal of the supply of the jack.

8. The installation according to claim 1 wherein the mechanism activated by the float includes a pivoting lever with unequal arms, the float being suspended on the shorter arm while a contact is provided which is activated by the longer arm of the lever, said contact controlling the jack supporting the hook in order to progressively move it from its high position to its low position.

* * * * *